United States Patent [19]

Dubas

[11] Patent Number: 4,822,506

[45] Date of Patent: Apr. 18, 1989

[54] LUBRICANT ADDITIVES CONTAINING SULFUR

[75] Inventor: Henri Dubas, Marly, Switzerland

[73] Assignee: Ciba-Geigy Corporation, Ardsley, N.Y.

[21] Appl. No.: 116,931

[22] Filed: Nov. 4, 1987

[30] Foreign Application Priority Data

Nov. 12, 1986 [CH] Switzerland ..... 4521/86

[51] Int. Cl.[4] ..... C10M 135/34

[52] U.S. Cl. ..... 252/45; 252/464; 252/47; 252/47.5; 252/48.2; 252/49.3; 549/33

[58] Field of Search ..... 252/45, 46.4, 47, 47.5, 252/48.2, 49.3; 549/33

[56] References Cited

U.S. PATENT DOCUMENTS 3,816,312 7/1974 Rossi et al. ..... 252/45
4,116,812 9/1978 Godar et al. ..... 252/45

FOREIGN PATENT DOCUMENTS 2242637 9/1971 Fed. Rep. of Germany .
1385950 5/1975 United Kingdom .
1575202 9/1980 United Kingdom .

OTHER PUBLICATIONS

C. Portail et al., Bull Soc. Chem. (France) 1966, 3187 (Chem. Abst. 66, 37804d).

*Primary Examiner*—William R. Dixon, Jr.
*Assistant Examiner*—Jerry D. Johnson
*Attorney, Agent, or Firm*—Luther A. R. Hall

[57] ABSTRACT

A composition containing a lubricant or a hydraulic fluid and at least one compound of the formula I

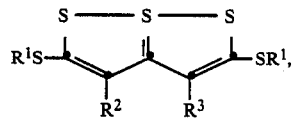

(I)

in which both $R^1$, independently of one another, are a hydrogen atom, a metal cation, $NH_4\oplus$, primary, secondary, tertiary or quaternary ammonium, linear or branched $C_1$–$C_{24}$-alkyl, unsubstituted or $C_1$–$C_{18}$-alkyl-substituted cycloalkyl or cycloalkylalkyl having 3 to 7 ring C atoms, $C_7$–$C_{16}$-aralkyl or $C_8$–$C_{40}$-alkaralkyl, where $C_1$–$C_{24}$alkyl may be substituted by —$NR^4R^5$, —$N\oplus R^4R^5R^6$, —$OR^7$, —$SR^7$, —$(C_mH_{2m}O)_nR^8$, —C(O)$OR^9$ or $C_1$–$C_{20}$-acyloxy, in which $R^4$, $R^5$ and $R^6$, independently of one another, are a hydrogen atom or unsubstituted or —OH-substituted $C_1$–$C_{20}$-alkyl, or $R^4$ and $R^5$ together are tetramethylene, pentamethylene or 3-oxapentylene, $R^7$ is a hydrogen atom, linear or branched $C_1$–$C_{18}$-alkyl, unsubstituted or $C_1$–$C_{12}$-alkyl-substituted cyclohexyl, phenyl or benzyl, $R^8$ is a hydrogen atom, $C_114$ $C_{18}$-alkyl or $C_1$–$C_{20}$-acyl, and $R^9$ is a hydrogen atom, the radical, reduced by one hydroxyl group, of a monohydric alcohol, a metal cation, or primary, secondary, tertiary or quaternary ammonium, m is an integer from 1 to 6, and n is a number from 1 to 20, $R^2$ and $R^3$, independently of one another, are a hydrogen atom or linear or branched $C_1$–$C_{20}$-alkyl, or $R^2$ and $R^3$ together are —$C_pH_{2p}$—in which p is an integer from 2 to 9.

The compounds of the formula I are suitable as anti-wear agents and as high-pressure additives for lubricants and hydraulic fluids.

14 Claims, No Drawings

LUBRICANT ADDITIVES CONTAINING SULFUR

The present invention relates to lubricant additives containing substituted thio-thiophthene derivatives, and also to novel substituted thio-thiophthene derivatives.

In general, additives are added to lubricants in order to improve the performance characteristics. Particular demands are placed on lubricants for transmission of relatively great forces with respect to the load-carrying capacity. By adding high-pressure and wear-reducing additives, the negative phenomena which otherwise appear are greatly reduced.

German Offenlegungsschrift No. 2,242,637 discloses thiothiophenes which are substituted by hydrocarbon groups and which are used as oxidation inhibitors in lubricants.

The present invention relates to a composition containing a lubricant or a hydraulic fluid and at least one compound of the formula I

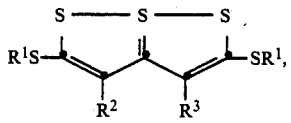

(I)

in which both $R^1$, independently of one another, are a hydrogen atom, a metal cation, $NH_4\oplus$, primary, secondary, tertiary or quaternary ammonium linear or branched $C_1$–$C_{24}$-alkyl, unsubstituted or $C_1$–$C_{18}$-alkyl-substituted cycloalkyl or cycloalkylalkyl having 3 to 7 ring C atoms, $C_7$–$C_{16}$-aralkyl or $C_8$–$C_{40}$-alkaralkyl, where the $C_1$–$C_{24}$-alkyl may be substituted by —$NR^4R^5$, —$N\oplus R^4R^5R^6$, —$OR^7$, —$SR^7$, —($C_mH_2$—C-(O)$OR^9$ or $C_1$–$C_{20}$-acyloxy, in which $R^4$, $R^5$ and $R^6$, independently of one another, are a hydrogen atom, or unsubstituted or —OH-substituted C–$C_{20}$-alkyl, or $R^4$ and $R^5$ together are tetramethylene, pentamethylene or 3-oxapentylene, $R^7$ is a hydrogen atom, linear or branched $C_1$–$C_{18}$-alkyl, unsubstituted or $C_1$–$C_{12}$-alkyl-substituted cyclohexyl, phenyl or benzyl, $R^8$ is a hydrogen atom, $C_1$–$C_{18}$-alkyl or $C_1$–$C_{20}$-acyl, and $R^9$ is a hydrogen atom, the residual, reduced by one hydroxyl group, of a monohydric alcohol, a metal cation, $NH_4\oplus$ or primary, secondary, tertiary or quaternary ammonium, m is an integer from 1 to 6, and n is a number from 1 to 20, $R^2$and $R^3$, independently of one another, are a hydrogen atom linear or branched $C_1$–$C_{20}$-alkyl, or $R^2$ and $R^3$ together are —$C_pH_{2p}$—, in which p is a number from 2 to 9.

A metal cation $R^1$ is preferably an alkali metal cation, an alkaline-earth metal cation or a transition metal cation. Of the transition metal cations, $Zn^{2+}$ and $Cu^{2+}$ are particularly preferred. Of the alkali metal and alkaline-earth metal cations, $Li\oplus$, $Na\oplus$, $K\oplus$. $Mg^{2+}$ and $Ca^{2+}$ are preferred. In a preferred subgroup, both $R^1$ H, $NH_4\oplus$, $Li\oplus$, $Na\oplus$, $K\oplus$, $Mg\oplus$, $Ca\oplus$, $Zn^{2+}$ and $Cu^{2+}$.

Primary, secondary, tertiary and quaternary ammonium $R^1$ can contain 1 to 40, preferably 1 to 30, C atoms. The N atoms may be substituted by unsubstituted or hydroxyl-substituted, linear or branched $C_1$–$C_{20}$-alkyl, unsubstituted or $C_1$–$C_6$-alkyl-substituted cycloalkyl or cycloalkyl-$C_1C_2$-alkyl having 4 to 7 ring C atoms, $C_1$–$C_{12}$-alkyl-substituted phenyl, benzyl or phenylethyl, or by unsubstituted or $C_1$–$C_4$-alkyl-substituted tri- or tetramethylene or 3-oxapentylene. In a preferred fashion, both ammonium $R^1$ in the formula I correspond to the formulae $R^{10}N\oplus H_3$, $R^{10}R^{11}N\oplus H_2$, $R^{10}R^{11}R^{12}N\oplus H$ or $R^{10}R^{11}R^{12}R^{13}N\oplus$ in which $R^{10}R^{12}$ and $R^{13}$, independently of one another, are unsubstituted or hydroxyl-substituted, linear or branched $dC_1$–$C_{18}$-alkyl, particularly $C_1$–$C_{12}$-alkyl and especially $C_1$–$C_6$-alkyl, In aqueous or aqueous-organic substrates, ammonium compounds in which $R^{10}$, $R^{11}$, $R^{12}$ and $R^{13}$ are unsubstituted or hydroxylsubstituted $C_1$–$C_4$-alkyl are expediently used for solubility reasons. In organic substrates, ammonium compounds in which the N atom is substituted by at least one long-chain, for example containing 6–20 C atoms, alkyl group are expediently used. A preferred group of such ammonium compounds is that in which, in the formulae defined above, $R^{10}$ is linear or branched $C_6$–$C_{18}$-alkyl and $R^{11}$, $R^{12}$ and $R^{13}$ are linear or branched $C_1$–$C_4$-alkyl.

Some examples of ammonium $R^1$are: methyl-, ethyl-, n- and i-propyl-, n-, i- and t-butyl-, pentyl-, hexyl-, heptyl-, octyl-, nonyl-, decyl-, undecyl-, dodecyl-, tetradecyl-, hexadecyl-, octadecyl-, eicosyl-, hydroxyethyl-, 2-hydroxypropyl-, dimethyl-, (methyl)(ethyl)-, diethyl-, dihydroxyethyl, dibutyl-, (methyl)(butyl)-, (methyl)-(hexyl)-, (methyl)(dodecyl)-, (methyl)(octadecyl)-, trimethyl-, triethyl-, trihydroxyethyl-, tri-n-butyl-, (hexyl)(dimethyl)-, (octyl)(di-methyl)-, (dodecyl)(dodecyl)-(dimethyl)-, (octadecyl)(dimethyl)-, tetramethyl-, tetraethyl-, tetrabutyl-, (trimethyl)ethyl-, (dimethyl)-(dibutyl)-, (trimethyl)(hexyl)-, (trimethyl)(dodecyl)-, (trimethyl)(octadecyl)-, cyclohexyl-, (cyclohexyl)-(dimethyl)-, cyclohexyl(trimethyl)-, (cyclohexyl)methyl-, (methylphenyl)-, (phenyl)(dimethyl)-,(methylbenzyl)-, (methyl)(benzyl)-, (benzyl)dimethyl-, (dimethylbenzyl)-, (nonylphenyl)-, (decylphenyl)-, (dodecylphenyl)-, (octadecylphenyl)- and (decylphenyl)(dimethyl)ammonium.

Unsubstituted alkyl $R^1$ is preferably linear or branched $C_1$–$C_{20}$—, particularly $C_2$–$C_{18}$—, in particular $C_2$–$C_{12}$— and very particularly $C_4$–$C_{12}$-alkyl. Examples of alkyl are methyl, ethyl, n- and i-propyl, n-, i- and t-butyl, n-pentyl, 2-methylbut-1-yl, n-hexyl, 2-methylpent-1-yl, 2-ethylpent-1 or -2-yl, n-heptyl, 2-n-propylhept-1-yl, n-octyl, 2-ethylhex-1-yl, nonyl, decyl, undecyl, dodecyl, tridecyl, tetradecyl, hexadecyl, octadecyl and eicosyl.

Aralkyl, preferably phenylalkyl, $R^1$ contains, in particular, 7 to 12 C atoms and is particularly benzyl, 1-phenyleth-2-yl, 1-phenyleth-1-yl, 1-phenyl-prop-1-, -2- or -3-yl.

In alkaralkyl $R^1$, the aryl group is preferably phenyl and the alkylene group is preferably 1,1- or 1,2-ethylene and particularly methylene. Alkaralkyl preferably contains 1 to 3, particularly 1 or 2, alkyl groups which preferably contain 1 to 20, particularly 1 to 12, C atoms and may be linear or branched. In particular, alkaralkyl $R^1$ is mono- or dialkylbenzyl having 8 to 20 C atoms. Examples of alkaralkyl are methylbenzyl, 1-(methylphenyl)eth-2-yl, dimethylbenzyl, ethylbenzyl, n- or 8-propylbenzyl, n- or t-butylbenzyl, di-t-butylbenzyl, hexylbenzyl, octylbenzyl, methylbutylbenzyl, nonylbenzyl, doctyl- or dinonylbenzyl, decylbenzyl, dodecylbenzyl, hexadecylbenzyl and octadecylbenzyl.

The cycloalkyl groups in cycloalkyl $R^1$ or cycloalkylalkyl $R^1$ are preferably cyclopentyl and particularly cyclohexyl. The alkylene group in cycloalkylalkyl is preferably ethylene and particularly methylene. If the cycloalkyl groups are substituted by alkyl, the alkyl preferably contains 1 to 12 and particularly 1 to 6 C atoms. The alkyl may be linear or branched. Some examples are methyl-, dimethyl-, ethyl-, propyl-, butyl-, pentyl-, hexyl-, octyl-, 3,3,5-trimethylcyclohexyl, decylcyclohexyl or -cyclopentyl, (methylcyclohexyl)-methyl, cyclopentylmethyl and cyclohexylmethyl.

Alkyl $R^1$ may be substituted as defined above. In this case, the alkyl preferably contains 1 to 12, particularly 1 to 6, and in particular 1 to 3, C atoms.

Alkyl $R^1$ may be substituted by amino or ammonium groups of the formula $—NR^4R^5$ or $—N^{\oplus}R^4R^5R^6$ in which $R^4$, $R^5$ and $R^6$ independently are preferably a hydrogen atom or unsubstituted or —OH-substituted $C_1$–$C_{18}$—, particularly $C_1$–$C_{12}$— and in particular $C_1$–$C_6$-alkyl. In aqueous or aqueous-organic substrates, components of the formula I in which $R^4$, $R^5$ or $R^6$ are unsubstituted or -OH-substituted $C_1$–$C_6$—, particularly $C_1$–$C_4$-alkyl or a hydrogen atom are expediently used. In organic substrates, compounds of the formula I in which $R^4$ is $C_6$–$C_{18}$-alkyl and $R^5$ and $R^6$ independently are a hydrogen atom or $C_1$–$C_6$-, particularly $C_1$–$C_4$-alkyl alkyl are advantageously used. Examples of alkyl groups have been listed above for ammonium $R^1$.

Alkyl $R^1$ may be substituted by $—OR^7$ or $—SR^7$. $R^7$ is preferably a hydrogen atom, linear or branched $C_1$–$C_{12}$-, particularly $C_1$–$C_6$-alkyl, unsubstituted or $C_1$–$C_4$-alkyl- substituted cyclohexyl, or unsubstituted or $C_1$–$C_{18}$-, particularly $C_1$–$C_{12}$-alkyl-substituted phenyl or benzyl. Examples of such alkyl groups have been listed above for alkyl-substituted cycloalkyl and alkaralkyl $R^1$. Examples of alkylphenyl $R^7$ are methyl-, dimethyl-, ethyl-, n- or i-propyl-, n-, i- or -t-butyl-, methyl-t-butyl-, di-t-butyl-, pentyl-, hexyl-, octyl-, dioctyl-, nonyl-, decyl-, dodecyl-, hexadecyl-, octadecyl-, dinonyl-, didecyl- and didodecylphenyl.

In acyloxy-substituted alkyl $R^1$, the acyloxy preferably contains 1 to 12 and particularly 1 to 6 C atoms. Examples of acyloxy are formyl-, acetyl-, propionyl-, butanoyl-, pentanol-, hexanoyl-, cyclohexanoyl-, octanoyl-, decanoyl-, do-decanoyl-, tetradecanoyl-, hexadecanoyl-, octadecanoyl- and benzoyloxy.

Alkyl $R^1$ may be substituted by the group of the formula $—(C_mH_{2m}O)_n—R^8$. In the formula, m is preferably an integer from 1 to 4 and n a number from 1 to 12, particularly 1 to 6. Alkyl and acyl $R^8$ preferably contain 1 to 12, particularly 1 to 6 C atoms. Examples of alkyl and acyl have been listed above. Examples of the $C_mH_2m$ group are ethylene, 1,2- or 1,3-propylene, 1,2-, 1,3- or 1,4-butylene, 1,5-penty-lene and 1,6-hexylene.

Alkyl $R^1$ may be substituted by the $—C(O)OR^9$ group. The preferences given for metal cation and ammonium $R^1$ apply to metal cation and ammonium $R^9$. $R^9$ as the radical of a monohydric alcohol preferably contains 1 to 18, particularly 1 to 12 and in particular 1 to 8 C atoms. It can be the radical of an aromatic and particularly an aliphatic alcohol. $R^9$ may be, for example, linear or branched $C_1$–$C_{20}$—, preferably $C_1$–$C_{18}$— and particularly $C_1$–$C_{12}$-alkyl, or unsubstituted or $C_1$–$C_{12}$—, particularly $C_1$–$C_6$-alkyl-substituted cyclohexyl, cyclopentyl, (cyclohexyl)methyl, phenyl or benzyl. Examples of such radicals have been listed above. In a preferred embodiment of the invention, both $R^1$ in formula I are $—C(O)OR^9$ substituted $C_1$–$C_6$-alkyl in which $R^9$ is as defined above. In a particularly preferred embodiment of the invention, both $R^1$ are the radical of the formula $—CH_2C(O)OR^9$ in which $R^9$ is H, $NH_4^{\oplus}$, a metal cation, primary, secondary, tertiary or quaternary ammonium or $C_1$–$C_{20}$-alkyl.

Alkyl $R^2$ and $R^3$ preferably contain 1 to 12, particularly 1 to 6, C atoms. Examples of alkyl have been listed above. In the $—C_pH_{2p}$— group, p is preferably an integer from 2 to 5, particularly 2 or 3 and in particular 3. Examples of the $—C_pH_{2p}$— group are ethylene, 1,2- or 1,3-propylene, 1,4-butylene, 1,5-pentylene, 2-methyl-1,3-propylene, 1,6-hexylene, 1,7-heptylene, 1,8-octylene and 1,9-nonylene.

In a preferred embodiment, $R^2$ and $R^3$ are a hydrogen atom or $C_1$–$C_4$-alkyl, or $R^2$ and $R^3$ together are the $—C_pH_{2p}$-group in which p is an integer from 2 to 5, particularly 2 or 3.

In another preferred embodiment of the invention, both $R^1$ in formula I, independently of one another, are a hydrogen atom, an alkali metal cation, an alkaline-earth metal cation or a transition metal cation, $NH_4^{\oplus}$, primary, secondary, tertiary or quaternary ammonium having $C_1$–$C_{18}$-alkyl groups, linear or branched $C_1$–$C_{12}$-alkyl, unsubstituted or $C_1$–$C_6$-alkyl-substituted cyclohexyl, $C_7$–$C_{12}$-phenylalkyl or $C_8$–$C_{30}$-alkylbenzyl, where the $C_1$–$C_{12}$-alkyl may be substituted by $—NR^4R^5$ or $—N^{\oplus}R^4R^5R^6$, $—OR^7$, $—SR^7$, $—C_mH_{2m})_nR^8$, $—C(O)OR^9$ or $C_1$–$C_{12}$-acyloxy, in which $R^4$, $R^5$ and $R^6$, independently of one another, are a hydrogen atom or $C_1$–$C_{18}$-alkyl, $R^7$ is a hydrogen atom, linear or branched $C_1$–$C_{12}$-alkyl or unsubstituted or $C_1$–$C_{12}$-alkyl-substituted phenyl or benzyl, $R^8$ is a hydrogen atom, $C_1$–$C_{12}$-alkyl or $C_1$–$C_{12}$-acyl, and $R^9$ is a hydrogen atom or the radical, reduced by one hydroxyl group, of a monohydric alcohol having 1 to 20 C atoms, m is an integer from 1 to 4 and n is a number from 1 to 6, $R^2$ and $R^3$, independently of one another, are a hydrogen atom or linear or branched $C_1$–$C_{12}$-alkyl, or $R^2$ and $R^3$ together are $—C_pH_{2p}$- in which p is an integer from 2 to 7.

The invention furthermore relates to the novel compounds of the formula Ia

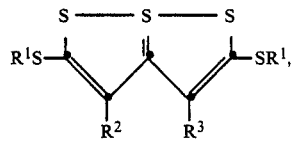

(Ia)

in which both $R^1$, independently of one another, are a hydrogen atom, a metal cation, $NH_4^{\oplus}$, primary, secondary, tertiary or quaternary ammonium, unsubstituted or $C_1$–$C_{18}$-alkyl-substituted cycloalkyl or cycloalkylalkyl having 3 to 7 ring C atoms, $C_7$–$C_{16}$-aralkyl or $C_8$–$C_{40}$-alkaralkyl, linear or branched $C_3$–$C_{24}$ alkyl, or $C_1$–$C_{24}$-alkyl which is substituted by $—NR^4R^5$, $—N^{\oplus}R^4R^5R^6$, $—OR^7$, $—SR^7$, $—(C_mH_{2m}O)_nR^8$, $—C(O)OR^9$ or $C_1$–$C_{20}$-acyloxy, in which $R^4$, $R^5$ and $R^6$, independently of one another, are a hydrogen atom or unsubstituted or —OH— substituted $C_1$–$C_{20}$-alkyl, or $R^4$ and $R^5$ together are tetramethylene, pentamethylene or 3-oxapentylene, $R^7$ is a hydrogen atom, linear or branched $C_1$–$C_{18}$-alkyl or unsubstituted or $C_1$–$C_{12}$-alkylsubstituted cyclohexyl, phenyl or benzyl, $R^8$ is a hydrogen atom, $C_1$–$C_{18}$-alkyl or $C_1$–$C_{20}$-acyl, and $R^9$ is a hydrogen atom, the radical, reduced by one hydroxyl group, of a monohydric alcohol, a metal cation, $NH_4^{\oplus}$ or primary, secondary, tertiary or quaternary ammonium, m is an integer from 1 to 6, and n is a number from 1 to 20, and $R^2$ and $R^3$, independently of one another, are a hydrogen atom or linear or branched $C_1$–$C_{20}$- alkyl, or $R^2$ and $R^3$ together are $—C_pH_{2p}—$ in which p is an integer from 2 to 9.

Alkyl $R^1$ in formula Ia preferably contains 6 to 18, particularly 6 to 12, C atoms. For the other meanings of $R^1$, $R^2$ and $R^3$ in formula Ia, the same preferences apply as these meanings for $R^1$, $R^2$ and $R^3$ in formula I.

Some of the compounds of the formula I are known or can be prepared by known processes. Suitable processes are described, for example by C. Portail et al. in Bull. Soc. Chim. Fr., 1966 (10), pp. 3187–3189. The compounds of the formula I can be prepared, for example, by reacting a compound of the formula II

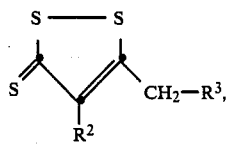

(II)

in which $R^2$ and $R^3$ are as defined in formula I, with $CS_2$ in the presence of an alkali metal alcoholate, and then either the compound of the formula I in which both $R^1$ are a hydrogen atom is isolated, or, by reaction with R'X, compounds of the formula I are prepared in which $R^1$ has the meaning of R' is unsubstituted or substituted alkyl, cycloalkyl, cycloalkylalkyl, aralkyl or alkaralkyl as defined for $R^1$ in formula I, and X is CL, Br or I.

The reaction can be carried out at temperatures from —20° C. to 40° C. The reaction is expediently carried out in an inert solvent, for example aromatic hydrocarbons, such as benzene, toluene or xylene. The compounds can be isolated in a conventional fashion by hydrolysing the reaction mixture using water, separating off the organic phase and subsequently distilling or crystallizing.

Compounds of the formula I in which $R^1$ and $R^9$ are a metal cation or ammonium can be prepared by reacting, in a known fashion, appropriate metal or ammonium bases with compounds of the formula I in which $R^1$ and $R^9$ in formula I are a hydrogen atom. This reaction can also take place in situ in lubricants and hydraulic fluids.

The compounds of the formula I are liquid compounds with various viscosities or crystalline compounds. Compared to thio-thiophthenes which are substituted by hydrocarbon radicals, they have an improved solubility in aqueous and organic substrates. In addition, the solubility can be specifically influenced through the choice of the $R^1$ group, and it is even possible to prepare water-soluble compounds, for example when $R^1$ and $R^9$ are a hydrogen atom, a metal cation or ammonium. In the case of viscous representatives, dilution, for example with a paraffin oil or alternatively with an appropriate base oil, offers a favourable form of formulation.

The compounds of the formula I are highly suitable as additives for lubricants and hydraulic fluids. The invention furthermore relates to the use of compounds of the formula I as additives in lubricants and hydraulic fluids. The addition of the compounds according to the invention leads to an improvement in performance characteristics, a surprising improvement in high-pressure and antiwear properties being found for pure sulfur compounds. Since the compounds do not contain any phosphorus, they are particularly suitable for engine oils since damage to catalytic converters can be avoided. In aqueous systems, there is a lower danger of infestation by microorganisms due to the absence of phosphorus.

The compounds of the formula I are expediently added to lubricants and hydraulic fluids in an amount of 0.01 to 10% by weight, preferably in an amount of 0.05 to 5% by weight, relative to the lubricant or hydraulic fluid. In organic systems, 0.1–2% by weight are advantageously used and in aqueous systems 0.05–5% by weight are advantageously used.

Such lubricant and hydraulic systems can be polar or nonpolar. The selection criteria arise from the solubility properties of the appropriate compounds.

Suitable lubricants are known to those skilled in the art and are described, for example, in "Schmiermittel Taschenbuch" [Lubricants Handbook] (Hüthig Verlag, Heidelberg, 1974) or by D. Klamann in "Schmierstoffe und verwandte Produkte" [Lubricants and Related Products], Verlag Chemie, Weinheim (1982).

Besides mineral oils, for example poly-α-olefins, particularly suitable lubricants are those based on esters, phosphates, glycols, polyglycols and polyalkylene glycols, and mixtures thereof with water, and water itself, which preferably also contains a thickener in order to increase the viscosity.

In addition, the lubricants can contain other additives which are added in order to further improve the basic properties of lubricants; these include: antioxidants, metal passivators, rust inhibitors, viscosity index improvers,pour-point depressors, dispersants, detergents, thickeners, biocides, defoamers, demulsifiers and emulsifiers and other high-pressure additives and friction reducers.

The concomitant use of zinc dialkyldithiophosphates has proven particularly advantageous since the action of the compounds of the formula I can be considerably increased. Zinc dialkyldithiophosphates having 1 to 18 C atoms, particularly 1–12 C atoms, in the alkyl groups are particularly suitable. Expediently, 0.01 to 15, particularly 0.1 to 10% by weight of zinc dialkyldithiophosphates are added, relative to the lubricant or the hydraulic fluid.

Examples of phenolic antioxidants as additional additives are:

1. Alkylated monophenols
2,6-di-tert-butyl-4-methylphenol
2,6-di-tert-butylphenol
2-tert-butyl-4,6-dimethylphenol
2,6-di-tert-butyl-4-ethylphenol
2,6-di-tert-butyl-4-n-butylphenol
2,6-di-tert-butyl-4-iso-butylphenol
2,6-di-cyclopentyl-4-methylphenol
2-(-α-methylcyclohexyl)-4,6-dimethylphenol
2,6-di-octadecyl-4-methylphenol
2,4,6-tri-cyclohexylphenol
2,6-di-tert-butyl-4-methoxymethylphenol
o-tert-butylphenol 2. Alkylated hydroquinones
2,6-di-tert-butyl-4-methoxyphenol
2,5-di-tert-butylhydroquinone
2,5-di-tert-amylhydroquinone
2,6-diphenyl-4-octadecyloxyphenol 3. Hydroxylated thiodiphenyl ethers
2,2'-thio-bis-(6-tert-butyl-4-methylphenol)
2,2'-thio-bis-(4-octylphenol)
4,4'-thio-bis-(6-tert-butyl-3-methylphenol)
4,4'-thio-bis-(6-tert-butyl-2-methylphenol)

4. Alkylidenebisphenols 2,2'-methylene-bis-(6-tert-butyl-4-methylphenol)
2,2'-methylene-bis-(6-tert-butyl-4-ethylphenol)
2,2'-methylene-bis-[4-methyl-6-(α-methylcyclohexyl)-phenol]
2,2'-methylene-bis-(4-methyl-6-cyclohexylphenol)
2,2'-methylene-bis-(6-nonyl-4-methylphenol)
2,2'-methylene-bis-(4,6-di-tert-butylphenol)
2,2'-ethylidene-bis-(4,6-di-tert-butylphenol)
2,2'-ethylidene-bis-(6-tert-butyl-4-iso-butylphenol)
2,2'-methylene-bis-[6-(α-methylbenzyl)-4-nonylphenol]
2,2'-methylene-bis-[6-(α,α-dimenthylbenzyl)-4-nonylphenol]
4,4'-methylene-bis-(2,6-di-tert-butylphenol)
4,4'-methylene-bis-(6-tert-butyl-2-methylphenol)
1,1-bis-(5-tert-butyl-4-hydroxy-2-methylphenyl)-butane
2,6-di-(3-tert-butyl-5-methyl-2-hydroxybenzyl)-4-methylphenol
1,1,3-tris-(5-tert-butyl-4-hydoxy-2-methylphenyl)-3-n-dodecylmercaptobutane
ethylene glycol bis-[3,3-bis-(3'-tert-butyl-4'-hydroxyphenyl)butyrate]
di-(3-tert-butyl-4-hydroxy-5-methylphenyl)-dicyclopentadiene
di-[2-(3'-tert-butyl-2'-hydroxy-5'-methyl-benzyl)-6-tert-butyl4-methylphenyl]terephthalate.

5. Benzyl compounds
1,3,5-tri-(3,5-di-tert-butyl-4-hydroxybenzyl)-2,4,6-trimethylbenzene
di-(3,5-di-tert-butyl-4-hydroxybenzyl) sulfide
isooctyl 3,5-di-tert-butyl-4-hydroxybenzylmercaptoacetate
bis-(4-tert-butyl-3-hydroxy-2,6-dimethylbenzyl) dithiolterephthalate
1,3,5-tris-(3,5-di-tert-butyl-4-hydroxybenzyl) isocyanurate
1,3,5-tris-(4-tert-butyl-3-hydroxy-2,6-dimethylbenzyl) isocyanurate
dioctadecyl 3,5-di-tert-butyl-4-hydroxybenzylphosphonate monoethyl
3,5-di-tert-butyl-4-hydroxybenzylphosphonate calcium salt.

6. Acylaminophenols
4-hydroxylauranilide
4-hydroxystearanilide
2,4-bis-octylmercapto-6-(3,5-di-tert-butyl-4-hydroxyanilino)s-triazine octyl N-(3,5-di-tert-butyl-4-hydroxyphenyl)-carbamate 7. Esters of β-(3,5-di-tert-butyl-4-hydroxyphenyl)-propionic acid
with mono- or polyhydric alcohols, such as with methanol, diethylene glycol, octadecanol, triethylene glycol, 1,6-hexanediol, pentaerythritol, neopentyl glycol, tris-hydroxyethylisocyanurate, thiodiethylene glycol, di-hydroxyethyloxalic diamide 8. Esters of β-(5-tert-butyl-4-hydroxy-3-methylphenyl)-propionic acid
with mono- or polyhydric alcohols, such as with methanol, diethylene glycol, octadecanol, triethylene glycol, 1,6-hexanediol, pentaerythritol, neopentyl glycol, tris-hydroxyethylisocyanurate, thiodiethylene glycol, di-hydroxyethyloxalic diamide 9. Amides of β-(3,5-di-tert-butyl-4-hydroxyphenyl)-propionic acid for example
N,Nα-di-(3,5-di-tert-butyl-4-hydroxypehnylpropionyl)-hexamethylene-diamine
N,N'-di-(3,5-di-tert-butyl-4-hydroxyphenylpropionyl)-trimethylene-diamine
N,N'-di-(3,5-di-tert-butyl-4-hydroxyphenylpropionyl)-hydrazine.

Examples of aminic antioxidants:
N,N'-di-isopropyl-p-phenylenediamine
N,N'-di-sec-butyl-p-phenylenediamine
N,N'-bis(1,4-dimethyl-pentyl)-p-phenylenediamine
N,N'-bis(1-ethyl-3-methyl-pentyl)-p-phenylenediamine
N,N'-bis(1-methyl-heptyl)-p-phenylenediamine
N,N'-diphenyl-p-phenylenediamine
N,N'-di-(naphtyl-2)-p-phenylenediamine
N-isopropyl-N'-phenyl-p-phenylenediamine
N-(1,3-dimethyl-butyl)-N'-phenyl-p-phenylenediamine
N-(1-methyl-heptyl)-N'-phenyl-p-phenylenediamine
N-cyclohexyl-N'-phenyl-p-phenylenediamine
4-(p-toluenesulfonamido)-diphenylamine
N,N'-dimethyl-N,N'-di-sec-butyl-p-phenylenediamine
diphenylamine
4-isopropoxy-diphenylamine
N-phenyl-1-naphthylamine
N-phenyl-2-naphthylamine
octylated diphenylamine
4-n-butylaminophenol
4-butyrylaminophenol
4-nonanoylaminophenol
4-dodecanoylaminophenol
4-octadecanoylaminophenol
di-(4-methoxy-phenyl)-amine
2,6-di=tert-butyl-4-dimethylaminomethylphenol
2,4'-diamino-diphenylmethane
4,4'-diamino-diphenylmethane
N,N,N',N'-tetramethyl-4,4'-diamino-diphenylmethane
1,2-di-[(2-methyl-phenyl)-amino]-ethane
1,2-di-(phenylamino)-propane
(o-tolyl)-biguanide
di-[4-(1',3'-dimethyl-butyl)-phenyl)amine
tert-octylated N-phenyl-1-naphthylamine
mixture of mono- and dialkylated tert-butyl-/tert-octyl-diphenylamines.

Examples of metal passivators are:
for copper, for example: triazole, benztriazole and derivatives thereof, 2-mercaptobenzthiazol, 2,5-dimercaptothiadiazole, salicylidene-propylenediamine, and salts of salicylaminoguanidine.

Examples of rust inhibitors are:
(a) Organic acids, their esters, metal salts and anhydrides, for example: N-oleoylsarcosine, sorbitan monooleate, lead naphthenate, dodecenylsuccinic anhydride, alkenylsuccinic monoesters, and 4-nonylphenoxyacetate.
(b) Nitrogen-containing compounds, for example:
I. Primary, secondary or tertiary aliphatic or cycloaliphatic amines and amine salts of organic and inorganic acids, for example oil-soluble alkylammonium carboxylates.
II. Heterocyclic compounds, for example: Substituted imidazolines and oxazolines.
(c) Phosphorus-containing compounds, for example: Amine salts of partial esters of phosphoric acid.
(d) Sulfur-containing compounds, for example: Barium dinonylnaphthalenesulfonate and calcium petroleumsulfonates Examples of viscosity index improvers are:
Polymethacrylates, vinyl pyrrolidone/methacrylate copolymers, polybutenes, olefin copolymers, styrene/acrylate copolymers and styrene/butadien copolymers.

Examples of pour-point depressors are:

Polymethacrylate and alkylated naphthalene derivatives.

Examples of dispersants/detergents are:

Polybutenylsuccinimides, polybutenylphosphonic acid derivatives, and basic magnesium, calcium and barium sulfonates and phenolates.

Examples of antiwear additives are:

Sulfur- and/or phosphorus- and/or halogen-containing compounds, such as sulfurized vegetable oils, zinc dialkyl- or zinc diaryldithiophosphates, tritolyl phosphate, chlorinated paraffins, alkyl and aryl disulfides, and carbamates.

The following examples illustrate the invention in greater detail. Parts are by weight, unless otherwise stated.

(A) PREPARATION EXAMPLES

Examples 1–5

A solution of 30 parts of 8,9-dithiabicyclo[4.3.0]$\Delta^{1,6}$-nonene-7-thione of the formula

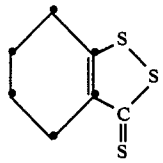

(A)

and 12 parts of $CS_2$ in 220 parts of toluene is added to a suspension of 35 parts of sodium tertiary-amylate (prepared by dissolving Na or NaH in t-amyl alcohol) in 220 parts of toluene at 0° C. The mixture is allowed to stand at 20° C. for 3 hours. 40 parts of ethyl chloroacetate are then added to the reaction mixture at 5° C., which is then allowed to stand for a further 3 hours. 190 parts of water are then added, the organic phase is separated from the aqueous phase, and the aqueous phase is extracted with toluene. The combined organic phases are washed with water and dried using $MgSO_4$. The crude product obtained (60 parts) is recrystallized from a 2:1 mixture of toluene/cyclohexane.

Examples 2–5

Using the method of Example 1, and retaining the stoichiometry, ethyl chloroacetate is replaced by the chlorine compounds given in Table 1 (Examples 2–4) or compound A is replaced by the compound of the formula

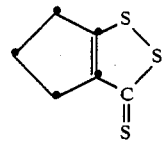

(B)

The compound of Example 3 is an oil which is not purified further.

The results are collated in Table 1.

TABLE 1

| Example | Chlorine compound | $R^1$ | $R^2$ | Melting point [°C.] | Solubility (% by weight) |
|---|---|---|---|---|---|
| 1 | ethyl chloroacetate | ethoxy-carbonyl-methyl | $-(CH_2)-_3$ | 124–5 | 0.08% in hexadecane |
| 2 | 1-chloro-n-hexane | n-hexyl | $-(CH_2)-_3$ | 74–77 | 0.97% in hexadecane |
| 3 | 2-ethylhexyl chloro-acetate | 2-ethyl-hexoxy-carbonyl-methyl | $-(CH_2)-_3$ | oil | miscible with hexadecane |
| 4 | chloroacetic acid | carboxy-methyl | $-(CH_2)-_3$ | 227–9 | >2.5% in $H_2O$ at pH 8.5 (KOH) |
| 5 | ethyl chloroacetate | ethoxy-carbonyl-methyl | $-(CH_2)-_2$ | 140–3 | 0.005% in hexadecane |

Example 6

A solution of 30 parts of 8,9-dithiabicyclo[4.3.0]$\Delta^{1,6}$-nonene-7-thion of the formula (A) and 12 parts of $CS_2$ in 22) parts of toluene is added to a suspension of 36 parts of sodium in 200 parts of toluene at 0° C. The mixture is allowed to stand at 20° C. for 3 hours. 220 parts of water are then added. The aqueous phase is separated off and acidified using 180 parts of 10% strength sulfuric acid under exclusion of atmospheric oxygen. The precipitate is filtered off under suction, washed with ice-cold water, a little ice-cold methanol and cyclohexene, and dried in the dark under a high vacuum. 31.5 parts of the garnet-red product of the formula (C) are obtained, which can be converted into the bis-methylated derivative (D) (melting point 148° C.) in 67% yield using dimethyl sulfate:

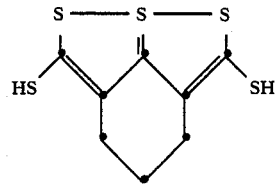

(C)

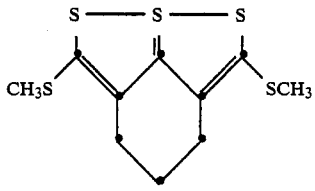

(D)

Example 7

5 parts of the product (C) from Example 6 are dissolved in 39 parts of 1N sodium hydroxide solution, and 3 parts of 2-chloroethanol are added at room temperature. After a few minutes, the product precipitates with evolution of heat. The reaction mixture is stirred for a further 2 hours, and the precipitate is then filtered off under suction and washed with water. The moist crude product is refluxed for 30 minutes with 150 parts of methanol, then cooled and filtered off under suction. 6 parts of a red-orange product of the formula (E)

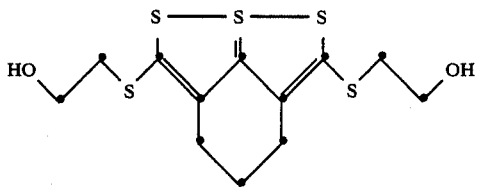

(E)

are obtained which melts at 134°-135.5° C. after additional purification.

Example 8

The product of Example 7 is estherified in toluene by conventional processes using 2-ethylhexanoyl chloride and triethylamine. A dark red oil of the formula (F) is obtained:

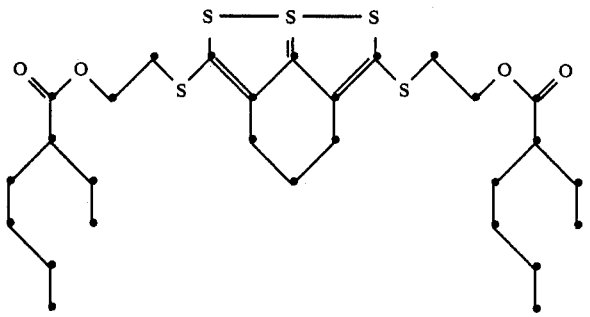

(F)

Example 9

Using the method of Example 7 and retaining the stoichiometry, chloroethanol is replaced by 1-(2-chlorethyl-) pyrrolidine. The product of the formula (G)

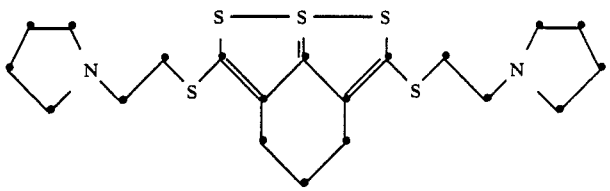

(G)

is obtained which melts at 105.5°-106.5° C.

Example 10

Using the method of Example 7 and retaining the stoichiometry, chloroethanol is replaced by 2-chloroethyl ethyl ether. The red product of the formula (H)

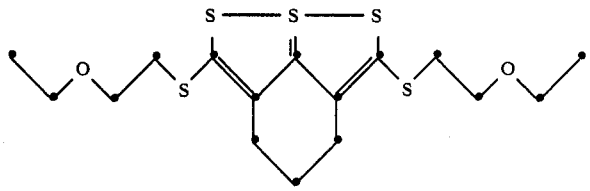

(H)

is obtained which melts at 72.4°-74° C.

(B) USE EXAMPLES

Example 11

The following values were determined using the shell four-ball machine (IP 239/73 Extreme pressure and wear lubricant test for oils and greases four-ball machine, ASTM D 2783-81):

1. W.L. = Weld Load. This is the load at which the 4 balls weld together within 10 seconds.
2. W.S.D. = Wear Scar Diameter in mm: This is the average wear diameter at a load of 40 kg for 10 or 30 minutes.

The test fluid used for the activity of the additives is a base oil from Shell (Catenex P 941 ®) and water containing 0.5% by weight of potassium hydroxide solution, 1.5% by weight of triethanolamine and 0.75% by weight of corrosion inhibitor (Reocor 184 ®, Ciba-Geigy). The pH of this solution along with the additive is 8.5. The results are given in Table 2. In addition, the evaluation of copper corrosion in accordance with ASTM D-130 is given.

TABLE 2

| Additives according to Example No. | W.L. (n) | W.S.D. (mm) | 0.25% of additive in base oil W.S.D. (mm) | Copper corrosion (1% of addition) | 2.5% of additive in water W.L. (N) | W.S.D. (mm) |
|---|---|---|---|---|---|---|
| | 1% of additive in base oil | | | | | |
| — | 1450 | 0.90 | | 1B | | |
| 2 | 2000 | 0.55 | 0.5 | 2C | | |
| 3 | 1800 | 0.5 | 0.5 | 2A | | |
| 4 | | | | | 4000 | 0.95 |
| 8 | 1600 | 0.55 | 0.52 | | | |
| | 0.8% of additive in base oil | | | | | |
| 9 | 2000 | 0.61 | 0.56 | | | |
| 10 | 2000 | 0.61 | 0.56 | | | |

Example 12

The wear cup is determined using a Reichert frictional wear tester (Reichert Wear Test DBGM 1749247) (Kadmer et al., Mineralöltechnik 1958 (2), 1-17).

In this wear tester, a securely clamped test roll is pressed, via a double lever system, against a rotating ring wheel, the lower third of which dips into the fluid to be tested and whose pressure take-up capacity is to be assessed. With the ring wheel rotating, scars (wear cups) appear on the test roll depending on the pressure take-up capacity of the fluid; the size of these depends on the load-carrying capacity of the test substance.

| Test conditions of the tester: | |
|---|---|
| Amount of fluid: | about 25 ml |
| Test element: | ring and rolls, crossed axes |
| Running speed: | 1.70 m/sec |
| Test duration: | 100 meter test distance |
| Ring and roll material: | steel, hardened |
| Standard load: | 1,000 p load weight |
| Type of friction: | sliding friction |
| Measurement parameters: | wear area in $mm^2$ |

The fluid used to test the effectiveness of the additives is water containing 0.75% by weight of corrosion inhibitor (Reocor 184 ®), 0.5% by weight of potassium hydroxide solution, 1.5% by weight of triethanolamine and 2.5% by weight of additive (pH 8.5). The result is given in Table 3.

Before and after the actual measurement run, control measurements are carried out using a mixture 50% by weight of water and 50% by weight of ethanol, wear values of about 40 $mm^2$ being observed.

TABLE 3

| Additive according to Example No. | Wear [$mm^2$] Experiment I | Repetition using solution* from Experiment I (Experiment II) | Repetition* using solution from Experiment II |
|---|---|---|---|
| none | 27 | 29 | 28 |
| 4 | 8.1 | 3.3 | 2.5 |

Example 13

The damage load behaviour is investigated in accordance with "Tribologie und Schmierungstechnik" 31/3, p. 164 (1984) using a cam-follower rig. As a modification of this description, measurements are carried out each hour at 1,000 N, 1,100 N, 1,200 N etc. to a maximum of 2,000 N or until notable wear appears. The measurement parameter is the damage load.

The fluid used for testing the effectiveness of the additives is an oil of specification SAE 10W-30. It comprises a mixture of 72.8% by weight of mineral oil (ISO VG 32), 11.2%. by weight of XOA 938 ® (Orogil) and 6% by weight of Viscoplex 610 ® (Roehm). The results are collated in Table 4 below.

TABLE 4

| Additive according to Example No. | Concentration (% by weight) | Damage load [N] |
|---|---|---|
| — | — | 1200 |
| 3 | 1 | 1400 |
| 3 | 0.5 | >2000 |
| zinc dialkyldithiophosphate[1] | 0.75 | |

[1]PCE 3-002 ® (Amoco)

Example 14

Using the method described by C.S. Ku and S.M. Hsu in Lubrication Engineering Vol. 40(2), 75-83 [1984] (Thin-film Oxygen Uptake Test, "TFOUT")[1], it is determined how long an additive is capable of protecting lubricants against metal ion-catalysed oxidative degredation. The values shown are average values of two independent test runs. The test fluid used is a typical engine oil (composition: mineral oil 82.05% (ISO-VG32); detergent/-dispersant 11.2%; VI-improver 6.0%; ZnDDP 0.75%), but which only contains half the amount of zinc dialkyldithiophosphate usually added. The results are included in Table 5.

TABLE 5

| Additive according to Example No. | Amount of additive (%) | Time to commencement of degredation (min) | Delay compared to oil without additive (min) | % |
|---|---|---|---|---|
| — | — | 86.5 | — | — |
| 8 | 0.5 | 98.5 | 12 | 14 |
| 9 | 0.5 | 153 | 66.5 | 77 |
| 10 | 0.5 | 125 | 38.5 | 42 |

[1] modified version of the standard ASTM D 2272 test.

What is claimed is:

1. A composition containing a lubricant or a hydraulic fluid and at least one compound of the formula I

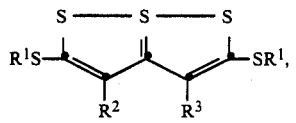

(I)

in which both $R^1$, independently of one another, are a hydrogen atom, a metal cation, $NH_4\oplus$, primary, secondary, tertiary or quaternary ammonium, linear or branched $C_1$–$C_{24}$-alkyl, unsubstituted or $C_1$–$C_{18}$-alkyl-substituted cycloalkyl or cycloalkylalkyl having 3 to 7 ring C atoms, $C_7$–$C_{16}$-aralkyl or $C_8$–$C_{40}$-alkaralkyl, where $C_1$–$C_{24}$-alkyl may be substituted by —$NR^4R^5$, —$N\oplus R^4R^5R^6$, —$OR^7$, —$SR^7$, —$(C_mH_mO)_nR^8$, —C(O)$OR^9$ or $C_1$–$C_{20}$-acyloxy, in which $R^4$, $R^5$ and $R^6$, independently of one another, are a hydrogen atom or unsubstituted or —OH-substituted $C_1$–$C_{20}$-alkyl, or $R^4$ and $R^5$ together are tetramethylene, pentamethylene or 3-oxapentylene, $R^7$ is a hydrogen atom, linear or branched $C_1$–$C_{18}$-alkyl, unsubstituted or $C_1$–$C_{12}$-alkyl-substituted cyclohexyl, phenyl or benzyl, $R^8$ is a hydrogen atom, $C_1$–$C_{18}$-alkyl or $C_1$–$C_{20}$-acyl, and $R^9$ is a hydrogen atom, $C_1$ to $C_{20}$ alkyl, a metal cation, $NH_4\oplus$ or primary, secondary, tertiary or quaternary ammonium, m is an integer from 1 to 6, and n is a number from 1 to 20, $R^2$ and $R^3$, independently of one another, are a hydrogen atom or linear or branched $C_1$–$C_{20}$-alkyl, or $R^2$ and $R^3$ together are —$C_pH_{2p}$— in which p is an integer from 2 to 9.

2. A composition according to claim 1 wherein, in formula I, both $R^1$, independently of one another, are a hydrogen atom, an alkali metal cation, an alkaline-earth metal cation or a transition metal cation, $NH_4\oplus$, primary, secondary, tertiary or quaternary ammonium having $C_1$–$C_{18}$-alkyl groups, linear or branched $C_1$–$C_{12}$-alkyl, unsubstituted or $C_1$–$C_6$-alkylsubstituted cyclohexyl, $C_7$–$C_{12}$-phenylalkyl or $C_8$–$C_{30}$-alkylbenzyl, where the $C_1$–$C_{12}$-alkyl may be substituted by —$NR^4R^5$ or —$N\oplus R^4R^5R^6$, —$OR^7$, —$SR^7$, -( $C_mH_2m$ )$_n$—$R^8$, —C(O)$OR^9$ or $C_1$–$C_{12}$-acyloxy, in which $R^4$, $R^5$ and $R^6$, independently of one another, are a hydrogen atom or $C_1$–$C_{18}$-alkyl, $R^7$ is a hydrogen atom, linear or branched $C_1$–$C_{12}$-alkyl, unsubstituted or $C_1$–$C_{12}$-alkyl-substituted phenyl or benzyl, $R^8$ is a hydrogen atom, $C_1$–$C_{12}$-alkyl or $C_1$–$C_{12}$-acyl, and $R^9$ is a hydrogen atom, linear or branched $C_1$–$C_{10}$-alkyl, m is an integer from 1 to 4, and n is a number from 1 to 6, $R^2$and $R^3$, independently of one another, are a hydrogen atom or linear or branched $C_1$–$C_{12}$-alkyl, or $R^2$ and $R^3$ together are —$C_pH_{2p}$— in which p is an integer from 2 to 7.

3. A composition according to claim 1, wherein both $R^1$ in formula I are H, $NH_4\oplus$, $Li\oplus$, $Na\oplus$, $K^+$, $Mg^{2+}$, $Ca^{2+}$, $Cu\oplus$ or $Zn^{2+}$.

4. A composition according to claim 1, wherein both ammonium $R^1$ in formula I have the formulae $R^{10}N\oplus H_3$, $R^{10}R^{11}N\oplus H_2$, $R^{10}R^{11}R^{12}N\oplus H$ or $R^{10}R^{11}R^{12}R^{13}N\oplus$, in which $R^{10}$, $R^{11}$, $R^{12}$ and $R^{13}$, independently of one another, are unsubstituted or hydroxyl-substituted, linear or branched $C_1$–$C_{18}$-alkyl.

5. A composition according to claim 4, wherein $R^{10}$ is linear or branched $C_6$–$C_{18}$-alkyl, an $R^{11}$, $R^{12}$ and $R^{13}$ are linear or branched $C_1$–$C_4$-alkyl.

6. A composition according to claim 1, wherein $R^4$, $R^5$ and $R^6$, independently of one another, are a hydrogen atom or unsubstituted or —OH-substituted $C_1$–$C_{12}$-alkyl.

7. A composition according to claim 1, wherein both $R^1$ in the formula I are linear or branched $C_2$–$C_{18}$-alkyl.

8. A composition according to claim 1, wherein both $R^1$ in the formula I are —C(O)$OR^9$-substituted $C_1$–$C_6$-alkyl, and $R^9$ is as defined in claim 1.

9. A composition according to claim 8, wherein both $R^1$ are the radical of the formula —$CH_2C(O)OR^9$ in which $R^9$ is H, $NH_4\oplus$, a metal cation, primary, secondary, tertiary or quaternary ammonium or $C_1$–$C_{20}$-alkyl.

10. A composition according to claim 1, wherein $R^2$ and $R^3$ are a hydrogen atom or $C_1$–$C_4$-alkyl, or $R_2$ and $R_3$ together are the —$C_pH_{2p}$— group in which p is an integer from 2 to 5.

11. A composition according to claim 1, wherein the compound of the formula I is present in an amount from 0.01 to 10% by weight, relative to the lubricant or the hydraulic fluid.

12. A composition according to claim 1, which additionally contains 0.01 to 15% by weight, relative to the lubricant or the hydraulic fluid, of a zinc dialkyldithiophosphate.

13. Process of improving the high pressure an antiwear properties of lubricants or hydraulic fluids by incorporation of a compound of the formula I according to claim 1 as an additive into said lubricants or hydraulic fluids.

14. A composition according to claim 10 wherein p is 2 or 3.

* * * * *